US012442214B2

(12) United States Patent
Richison

(10) Patent No.: US 12,442,214 B2
(45) Date of Patent: Oct. 14, 2025

(54) FENCE POST ASSEMBLY

(71) Applicant: Brett Jason Richison, Jenks, OK (US)

(72) Inventor: Brett Jason Richison, Jenks, OK (US)

(73) Assignee: FENCETRAC FENCE SYSTEMS, INC., Tulsa, OK (US)

( * ) Notice: Subject to any disclaimer, the term of this patent is extended or adjusted under 35 U.S.C. 154(b) by 549 days.

(21) Appl. No.: 17/693,950

(22) Filed: Mar. 14, 2022

(65) Prior Publication Data

US 2023/0287705 A1 Sep. 14, 2023

(51) Int. Cl.
*E04H 17/14* (2006.01)
*E04H 17/20* (2006.01)

(52) U.S. Cl.
CPC ..... *E04H 17/1456* (2021.01); *E04H 17/20* (2013.01)

(58) Field of Classification Search
CPC ... E04H 17/003; E04H 17/006; E04H 17/013; E04H 17/1413; E04H 17/1447; E04H 17/1452; E04H 17/1456; E04H 17/1465; E04H 17/1469; E04H 17/1486; E04H 17/1488; E04H 17/168; E04H 17/20; E04H 17/21; E04H 17/24
See application file for complete search history.

(56) References Cited

U.S. PATENT DOCUMENTS 2,789,792 A 4/1957 Davis
2,873,094 A 2/1959 Blum
3,037,593 A 6/1962 Webster
3,157,255 A 11/1964 Sondheim
3,395,489 A 8/1968 Banse
3,454,262 A 7/1969 Romano
3,522,933 A 8/1970 Braun, III
(Continued)

FOREIGN PATENT DOCUMENTS

CA 2683274 A1 4/2010
FR 2646195 A 4/1989
(Continued)

OTHER PUBLICATIONS

Bradford, "Modular Fence Frame System", Jul. 27, 2011, Publisher: www.invention.net/bradford.htm.

*Primary Examiner* — Amber R Anderson
*Assistant Examiner* — Kevin J Baynes
(74) *Attorney, Agent, or Firm* — James F. Lea, III; Gable Gotwals

(57) ABSTRACT

A fence assembly that permits assembly a series of main posts and secondary members for constructing a fence having a desired shape and functionality. The main post has a front and rear connector for receiving a secondary member such as a cap, a corner member, an angle member, or a gate member. The main post may define a filler receptacle for receiving infill. The main post or secondary members may define a channel for serving as a screw guide or for receiving an accessory. In use, fence installation includes installing a main post in the ground and slidably engaging a secondary member with the main post. Infill may be located within a filler receptacle defined by the main post. Additional secondary members and/or main posts may be slidably affixed together to allow a user to assemble main posts and secondary members for constructing a fence in a desired configuration.

18 Claims, 9 Drawing Sheets

(56) References Cited

U.S. PATENT DOCUMENTS 3,648,981 A 3/1972 Allen
3,738,083 A * 6/1973 Shimano ..... E04B 1/34315 52/584.1
3,879,017 A * 4/1975 Maxcy ..... E04F 11/181 256/22
3,918,686 A 11/1975 Knott et al.
4,055,909 A 11/1977 Perry
4,101,226 A * 7/1978 Parisien ..... F16B 7/0446 403/4
4,114,860 A * 9/1978 Parisien ..... E04H 17/124 248/200
4,159,820 A 7/1979 Parisien
4,188,019 A 2/1980 Meredith
4,240,615 A * 12/1980 Sickler ..... E04H 17/1413 256/60
4,594,829 A * 6/1986 Herrgord ..... E05D 1/04 52/282.3
4,804,166 A 2/1989 Makus
4,809,955 A 3/1989 Mlleux
5,192,056 A 3/1993 Espinueva
5,360,121 A 11/1994 Sothman
5,400,563 A * 3/1995 House ..... E04C 2/06 52/745.1
5,480,126 A 1/1996 Teasdale
5,520,477 A * 5/1996 Fink ..... F16B 5/0028 403/231
5,529,288 A 6/1996 Cheng-I
5,533,848 A 7/1996 Davis
5,553,424 A 9/1996 Gazaway
5,575,127 A 11/1996 O'Neal
5,702,090 A 12/1997 Edgman
5,758,459 A 6/1998 Koike et al.
5,938,184 A 8/1999 Desouza
5,988,599 A 11/1999 Forbis
6,012,244 A 1/2000 Begum et al.
6,039,307 A * 3/2000 De Zen ..... E04H 17/1439 256/66
6,041,486 A 3/2000 Forbis
6,152,428 A 11/2000 Simioni
6,202,987 B1 3/2001 Forbis
6,238,456 B1 * 5/2001 Wolf ..... H01G 9/0525 75/622
6,289,641 B1 9/2001 McCandless
6,311,955 B1 11/2001 McGarry et al.
6,345,809 B1 2/2002 Bebendorf
6,364,141 B1 4/2002 Ehrgott
6,398,193 B1 6/2002 Desouza
6,478,287 B2 11/2002 Desouza
6,546,675 B1 * 4/2003 Adderton ..... E04B 2/7435 52/282.1
6,595,497 B1 7/2003 Linford et al.
6,719,277 B2 4/2004 Ohanesian
6,772,998 B2 8/2004 Bebendorf
6,779,781 B2 8/2004 Bebendorf
6,827,592 B2 12/2004 McCoy et al.
6,840,388 B2 1/2005 Mayer
6,863,326 B1 3/2005 Tiesler et al.
6,877,721 B2 4/2005 Calverley
6,912,817 B1 7/2005 Sabac et al.
7,036,799 B2 5/2006 Shepherd
7,503,550 B2 3/2009 Liefke
7,571,583 B2 8/2009 Winfield
7,635,115 B2 12/2009 Lehmann
7,690,629 B1 * 4/2010 Briggs ..... E04H 17/168 256/65.12
7,730,682 B2 6/2010 Nash
D621,061 S 8/2010 Petrucelli et al.
7,775,009 B2 8/2010 King
7,958,684 B2 6/2011 Kleege
7,997,560 B2 8/2011 Bergdoll
8,028,974 B2 * 10/2011 Mann ..... E04H 17/20 256/DIG. 5
8,056,235 B1 * 11/2011 Briggs ..... E04H 17/1413 29/521
8,327,591 B2 12/2012 Wilkinson, Jr. et al.
8,336,273 B2 12/2012 Enns
8,640,761 B2 2/2014 Potter
8,671,640 B1 * 3/2014 Thomas ..... E04B 2/18 52/607
8,763,303 B2 7/2014 Johnson et al.
10,760,299 B2 * 9/2020 Preston ..... E04H 17/168
2003/0222257 A1 12/2003 Bebendorf
2006/0113517 A1 6/2006 Colantonio et al.
2006/0186390 A1 * 8/2006 Richards ..... E04H 17/1413 256/22
2006/0278862 A1 12/2006 Ohanesian
2007/0045602 A1 3/2007 Hathorn, Jr.
2007/0145340 A1 * 6/2007 Brabeck ..... E04H 17/163 256/24
2009/0194754 A1 8/2009 Timothy
2010/0096608 A1 4/2010 McCarthy et al.
2010/0314597 A1 12/2010 Rodriguez et al.
2011/0042637 A1 2/2011 Howard et al.
2011/0121249 A1 5/2011 Walker
2013/0074401 A1 * 3/2013 Forno ..... A01K 1/033 47/33
2013/0248792 A1 9/2013 Bangratz
2016/0069101 A1 * 3/2016 Pooch ..... E01F 8/0011 29/897.3
2019/0284833 A1 * 9/2019 Yeh ..... E04H 17/1447

FOREIGN PATENT DOCUMENTS

GB 2139666 A * 11/1984 ..... E04H 17/20
KR 20110009003 U * 9/2011 ..... E04H 17/1488

* cited by examiner

FENCE POST ASSEMBLY

FIELD OF THE INVENTION

The present disclosure relates to fences and fence posts. More particularly-, the invention relates to fence posts and secondary members having compatible engaging surfaces for facilitating on-site construction in a desired configuration.

BACKGROUND OF THE INVENTION

The use of fences is widespread. Fences are available in various materials and configurations to meet the needs of consumers. For example, common fence types for residential or light commercial use include chain link fence and picket fence. However, variations of these types or configurations of fences are available to provide aesthetic alternatives for consumers. Some fence variants provide fence panels that are assembled off-site and transported to the installation site. Other fence variants require multiple workers to construct and erect fence components and fence panels.

SUMMARY OF THE INVENTION

The fence system of the invention is a versatile fence assembly that facilitates allowing a user to assemble a series of main posts and secondary members for constructing a fence having a desired shape and having a desired functionality. In one embodiment, various fence components, such as posts, angle members, corner members, caps and gate members, may be slidably engaged with one another is a user desired configuration.

The fence of the invention has a main post having a height, a front member, a rear member, a first end, a second end, and a center member. The front member has an outside, an inside, and a terminal end. The rear member has an outside, an inside, and a terminal end. The center member has a first side and a second side. The center member connects the front member and the rear member.

A front connector is provided at the terminal end of the front member and a rear connector is provided at the terminal end of the rear member. The front connector and the rear connector receive a secondary member.

In one embodiment, a filler receptacle is defined by the main post on one of the first side and the second side of the center member. Infill may be received in the filler receptacle.

In one embodiment, one of the outside of the front member and the outside of the rear member defines a channel, wherein the channel serves as a screw guide for securing the infill to the main post. In one embodiment, the channel is provided with retaining members for forming an accessory track for receiving an accessory.

The secondary member may be one of a cap, a corner member, an angle member, and a gate member. In one embodiment, the secondary member defines a channel wherein the channel serves as a screw guide for securing infill to the secondary member. In one embodiment, the channel is provided with retaining members for forming an accessory track for receiving an accessory.

In one embodiment, the cap is received by the front connector of the main post and by the rear connector of the main post for covering a filler receptacle.

In one embodiment, the corner member may be received by the front connector of the main post and by the rear connector of the main post facilitating a right angle bend in the fence. In one embodiment, the corner member defines a first corner post connector and a second corner post connector wherein the first corner member connector of the corner member and the front connector of the main post each define a shape such that each can receive components having a complementary shape compatible with each, and the second corner member connector of the corner member and the rear connector of the main post each define a same shape such that each can receive components having a complementary shape compatible with each.

In one embodiment, the angle member is received in the front connector and the rear connector for facilitating an angled bend in the fence, the angle member defining a first angle member connector and a second angle member connector. In one embodiment, the angled bend facilitated by the angle member is between 1 and 89 degrees. The angled be provided in various forms, preferably between 15 and 75 degrees, more preferably between 30 and 60 degrees, and more preferably approximately 45 degrees to allow a user to construct a fence having a desired configuration. In one embodiment, the first angle member connector of the angle member and the front connector of the main post each define a shape such that each can receive components having a complementary shape compatible with each, and the second angle member connector of the angle member and the rear connector of the main post each define a same shape such that each can receive complimentary shaped components compatible with each.

In practice, construction of the fence includes the steps of installing a main post in a ground surface, slidably engaging a secondary member with a front connector at a terminal end of a front member of the main post and with a rear connector of the main post at a terminal end of a rear member.

In one embodiment, infill is located within a filler receptacle defined by the main post on one of the first side and the second side of a center member of the main post.

In one embodiment, a screw is passed through the one of the front member and the rear member of the main post for securing the infill within the filler receptacle.

In one embodiment, one of the front member and the rear member of the main post define a channel, wherein a screw is passed through the channel, wherein the channel serves as a screw guide for securing the infill to the main post. In one embodiment, the channel is provided with retaining members for receiving an accessory.

In one embodiment, the secondary member is selected from a group consisting of a cap, a corner member, an angle member, and a gate member.

Inn one embodiment, the secondary member defines connectors, wherein the connectors of the secondary member and the front connector of the front member of the main post each define a shape such that each can receive components having a complementary shape compatible with each, and the secondary member defines connectors, wherein the connectors of the secondary member and the rear connector of the rear member of the main post each define a shape such that each can receive components having a complementary shape compatible with each, wherein the compatibility of the connectors of the secondary member, the front connector of the main post and the rear connector of the main post allow a user to assemble a series of main posts and secondary members for constructing a fence having a desired shape and having a desired functionality.

DETAILED DESCRIPTION OF THE PREFERRED EMBODIMENTS

Figure 1:
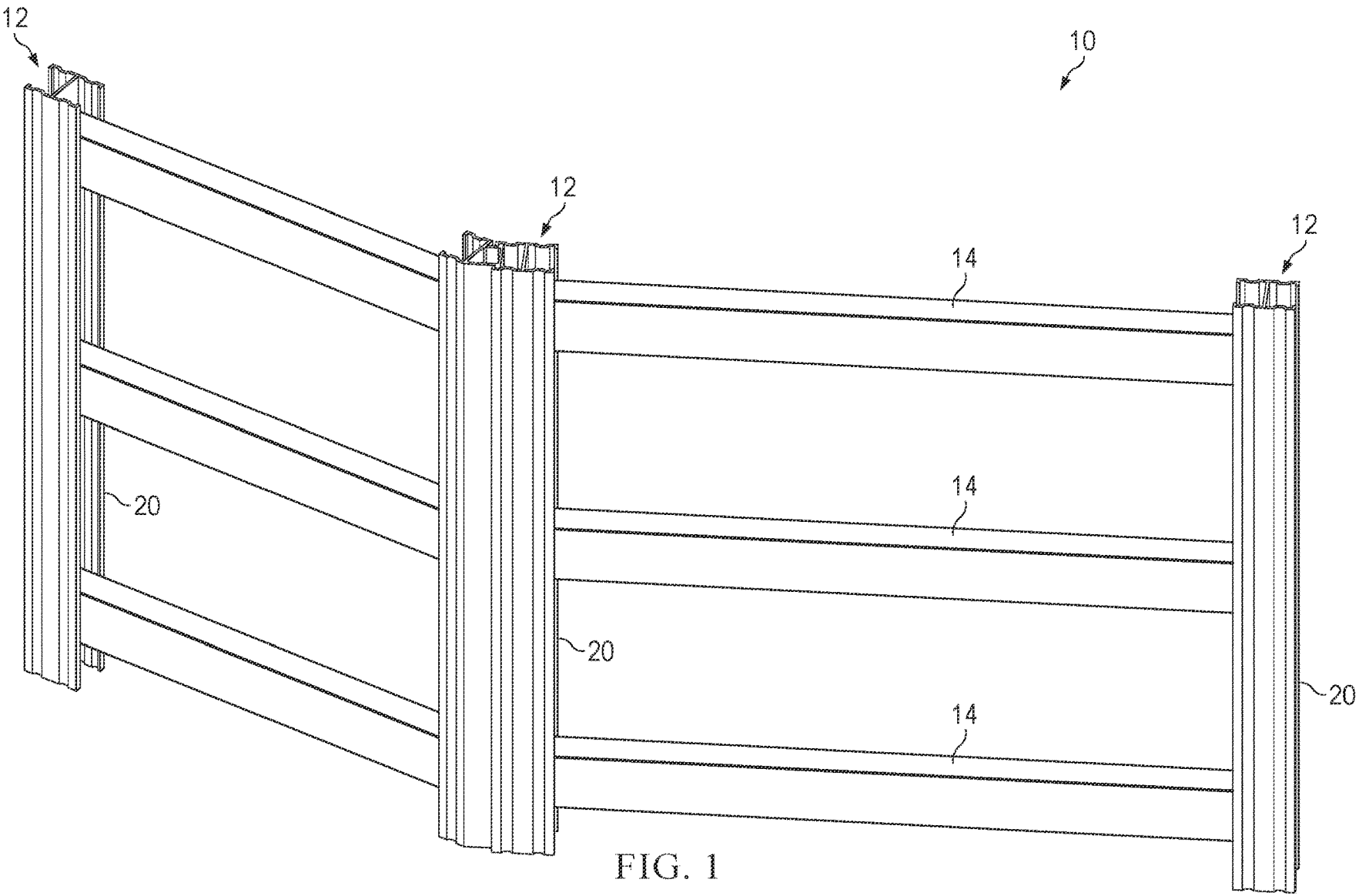
FIG. 1 is perspective view of a fence post assembly including a main post of the invention.

Referring now to FIG. 1, shown is a fence post assembly designated generally 10.

Fence post assembly 10 includes main post 12 and a plurality of infill members 14, such as horizontal slats 16 or other infill members 14 such as panels, horizontal slats, vertical slats, or other types of infill.

Figure 2:
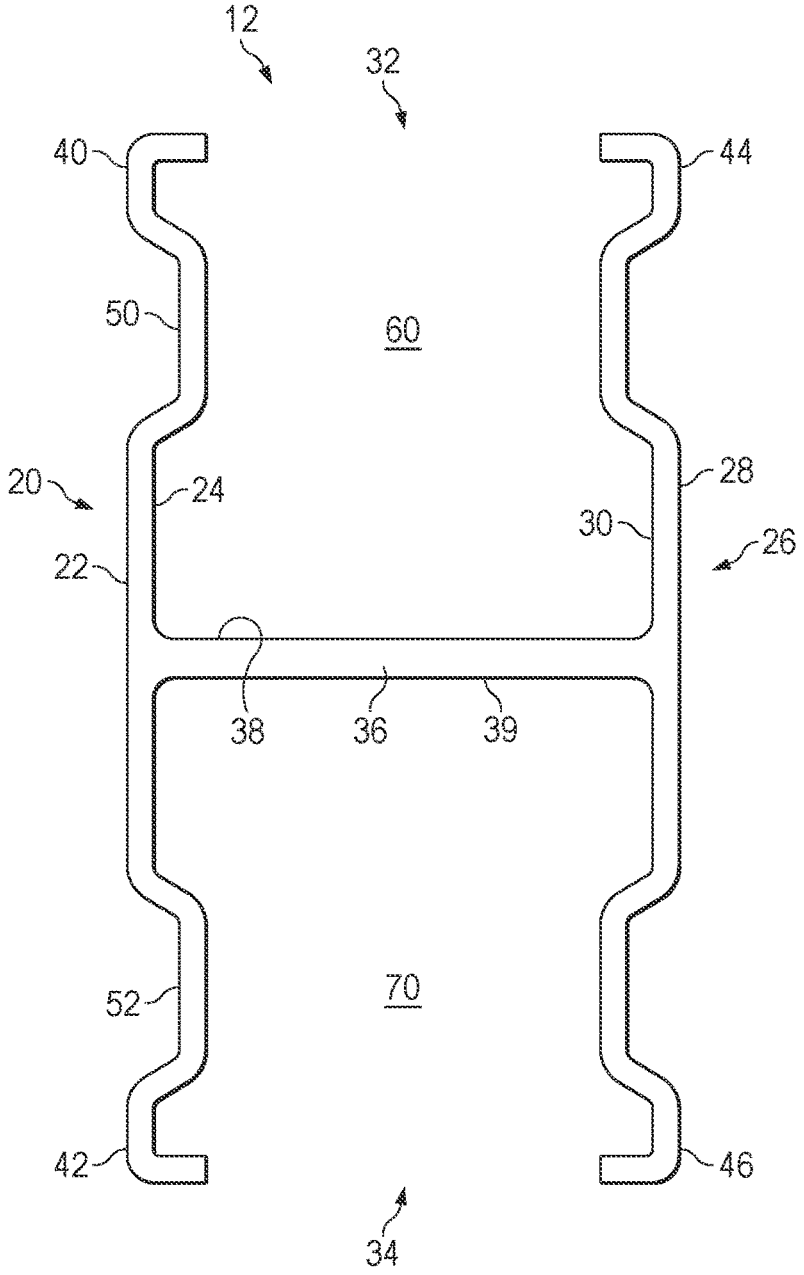
FIG. 2 is a plan view of the main post of the fence post assembly of FIG. 1.

Referring now to FIGS. 1 and 2, shown is main post 12 having a height. Main post 12 has a front member 20 having an outside 22 and an inside 24, Main post 12 includes rear member 26 having an outside 28 and an inside 30. Main post 12 has first end 32 and second end 34. Main post 12 additionally has center member 36 having a first side 38 and a second side 39. Center member 36 is for connecting front member 20 and rear member 26.

First front connector 40 is located on front member 20 at first end 32 of main post 12. Second front connector 42 is located on front member 20 at second end 34 of main post 12. First rear connector 44 is located on front member 20 at front end 32 of main post 12. Second rear connector 46 is located on rear member 26 at second end 34 of main post 12.

Outside 22 of front member 20 defines first channel 50 and second channel 52 for, e.g., receiving accessories and for serving as a screw guide.

First filler receptacle 60 is defined by inside 24 of front member 20, first side 38 of center member 36 and inside 30 of rear member 26 on first side 38 of center member 36.

Second filler receptacle 70 is defined by inside 24 of front member 20 on second side 39 of center member 36, second side 39 of center member 32 and inside 30 of rear member 6 on second side 39 of center member 36.

Secondary member 80 is adapted to be received on first front connector 40 of front member 20 and first rear connector 44 of rear member 26 or on second front connector 42 of front member 20 and second rear connector 46 of rear member 26 for facilitating efficient installation of secondary member 80 for configuring fence assembly 10 in a desired configuration.

Figure 3:
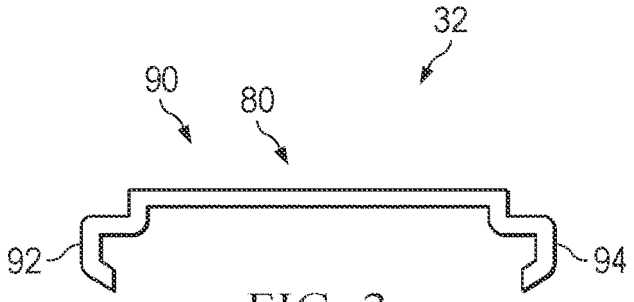
FIG. 3 is a plan view of a secondary member in the form of a cap for being received in connectors of the main post of FIGS. 1 and 2.
Figure 4:
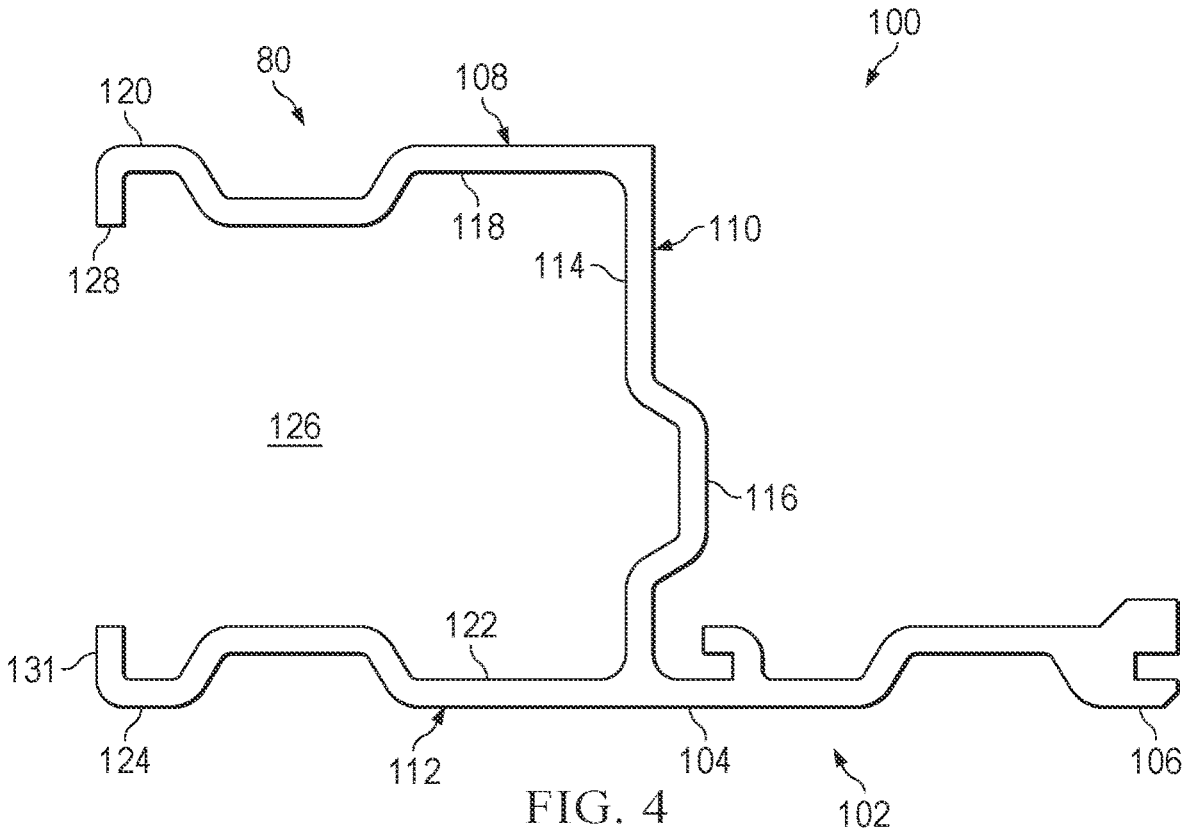
FIG. 4 is a plan view of a secondary member in the form of a corner member for being received in connectors of the main post of FIGS. 1 and 2.
Figure 5:
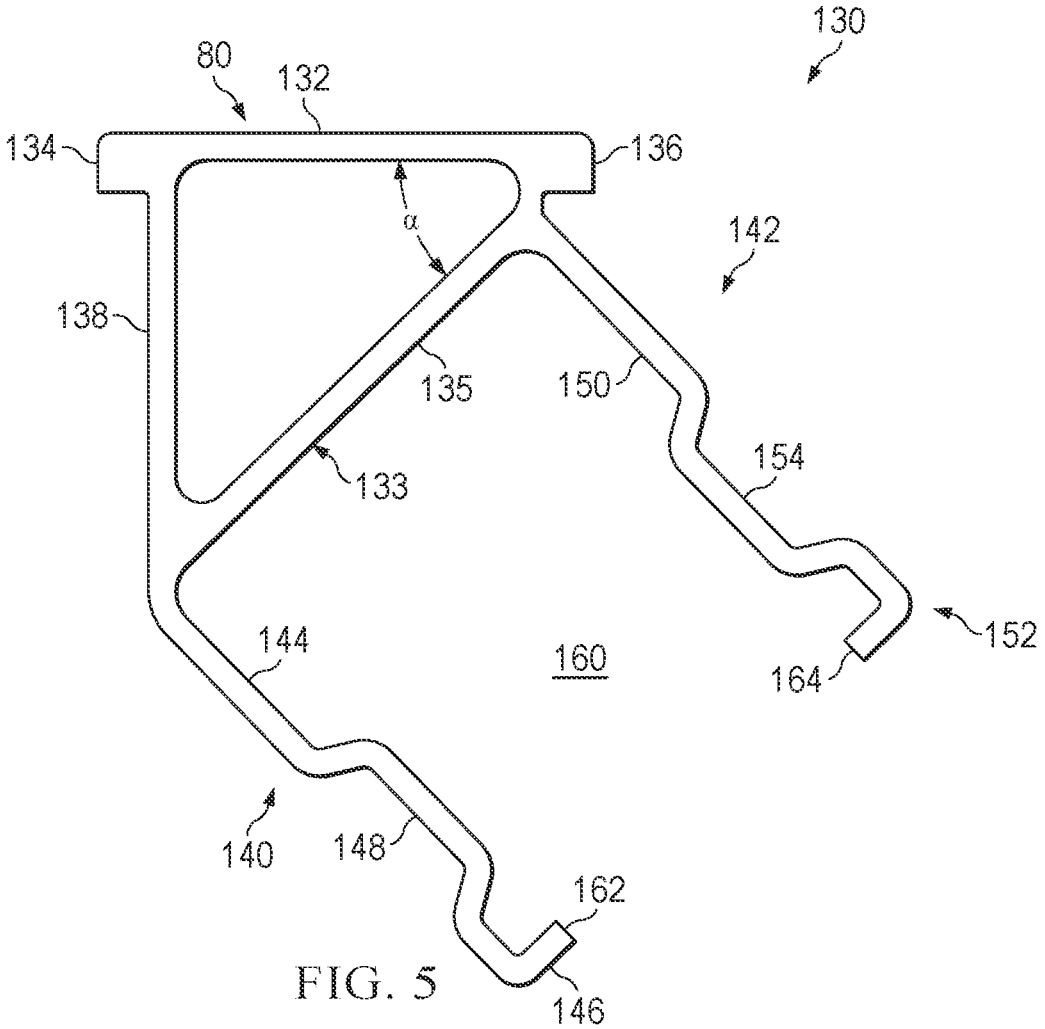
FIG. 5 is a plan view of a secondary member in the form of an angle member for being received in connectors of the main post of FIGS. 1 and 2.
Figure 6:
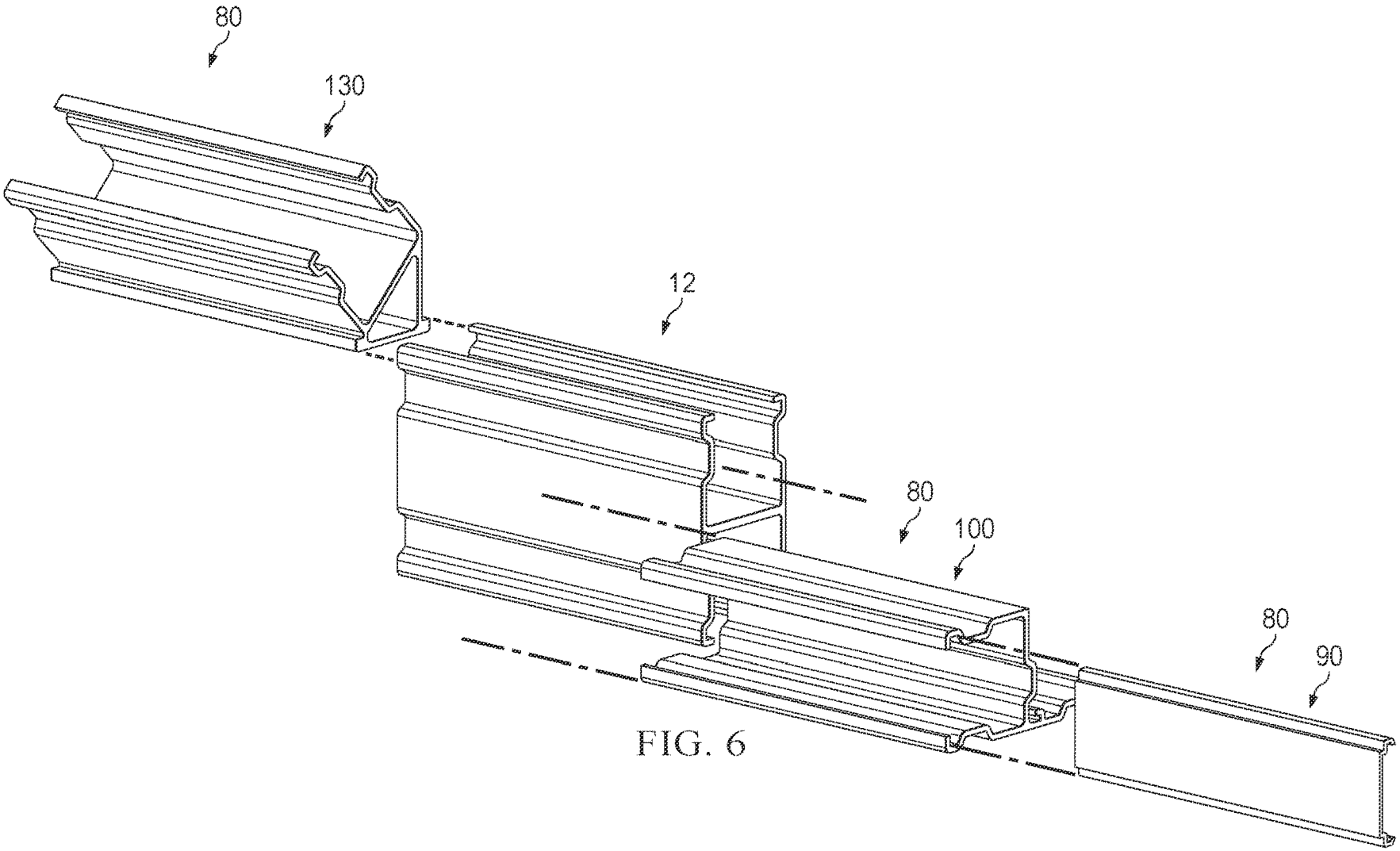
FIG. 6 is perspective view showing the main post of FIGS. 1 and 2 adapted to slidably receive the angle post, corner post and cap of FIGS. 3, 4 and 5.
Figure 7:
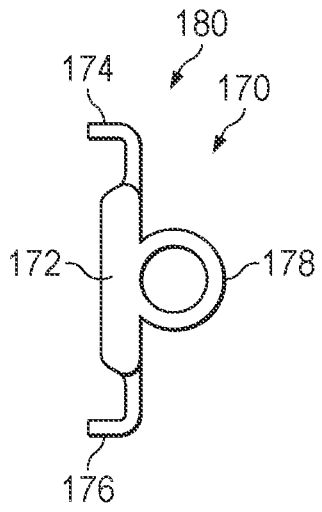
FIG. 7 is a plan view of a secondary member in the form of a gate hinge member.

Secondary member 80 is preferably selected from a group consisting of cap 90 (FIG. 3, 6), corner post 100 (FIG. 4, angle post 130 (FIG. 5, 6) and gate post 170 (FIG. 7).

Cap 90 is adapted for installation on one of first end 32 and second end 34 of main post 12. Cap 90 has an end 92 adapted to connect to first front connector 40 or second front connector 42 of front member 20 of main post 12. Cap 90 has another end 94 adapted to connect to first rear connector 44 or second rear connector 46 of rear member 26 of main post 12. Cap 90 is for covering first filler receptacle 60 or second filler receptacle 70 for providing an attractive appearance to fence post assembly 10, at an end of assembled fence 10 where one of first filler receptacle 60 or second filler receptacle 70 may be exposed.

Corner post 100 is adapted for installation on one of first end 32 and second end 39 of main post 12. Corner post 100 has arm 102 adapted to be affixed to one of first end 32 and second end 34 of main post 12. Arm 102 has first feature 104 adapted to connect to first front connector 40 or second front connector 42 of front member 20 and adapted to connect to first rear connector 44 or second rear connector 46 of rear member 26. Arm 102 has second feature 106 adapted to connect to first front connector 40 or second front connector 42 of front member 20 and adapted to connect to first rear connector 44 or second rear connector 46 of rear member 26. Corner post 100 further has first side 108, mating side 110, and second side 112. Mating side 110 defines inside surface 114 and mating side protrusion 116 for engaging with one of channels 50, 52 of main post 12. First side 108 has inside surface 118 and first terminal end 120. Second side 112 has inside surface 122 and second terminal end 124. Filler receiving area 126 is defined by inside surface 118 of first side 108, inside surface 114 of mating side 110, and inside surface 122 of second side 112. First terminal end 120 defines first corner post connector 128. Second terminal end 124 defines second corner post connector 131. First corner post connector 128 and second corner post connector 131 have a complementary shape for slidable connection with first front connector 40, first rear connector 44, second front connector 42, and second rear connector 46 of main post 12.

Angle post 130 is adapted for installation on one of first end 32 and second end 34 of main post 12. Angle post 130 has an attachment member 132 having a first end 134 adapted to connect to first front connector 40, second front connector 42, first rear connector 44 or second rear connector 46 of main post 12. Angle post 130 has a second end 136 adapted to connect to first front connector 40, second front connector 42, first rear connector 44 or second rear connector 46 of main post 12. Attachment member 132 communicates with interior angle member 133. Interior angle member 133 defines an angle alpha with respect to attachment member 132. Internal angle member 133 has an inside surface 135. In one embodiment, angle alpha is 45 degrees.

Angle alpha may be of a different value, e.g., 30 degrees or 60 degrees, 45 degrees or any size between 1 and 90 degrees. Opposite angle alpha is extension member 138. First side member 140 and second side member 142 extend outwardly from interior angle member 133. First side member 140 defines an inside surface 144, a terminal end 146, and a channel 148. Second side member 142 defines an inside surface 150, a terminal end 152 and a channel 154.

Inside 144 of first side member 140, inside 135 of internal angle segment 133 and inside 150 of second side 142 define filler receiving area 160. First terminal end 146 defines first angle post connector 162. Second terminal end 152 defines second angle post connector 164. First angle post connector 162 and second angle post connector 164 have a complementary shape for being slidably received by first front connector 40, first rear connector 44, second front connector 42, and second rear connector 46 of main post 12.

Gate post 170 is adapted for installation on one of first end 32 and second end 34 of main post 12. Gate post 170 has an attachment member 172 having a first end 174 adapted to connect to first front connector 40, first rear connector 44, second front connector 42, and second rear connector 46 of main post 12. Gate post 170 has a second end 176 adapted to connect to connect to first front connector 40, first rear connector 44, second front connector 42, and second rear connector 46 of main post 12. Hinge member 178 is affixed to attachment member 172.

Figure 8:
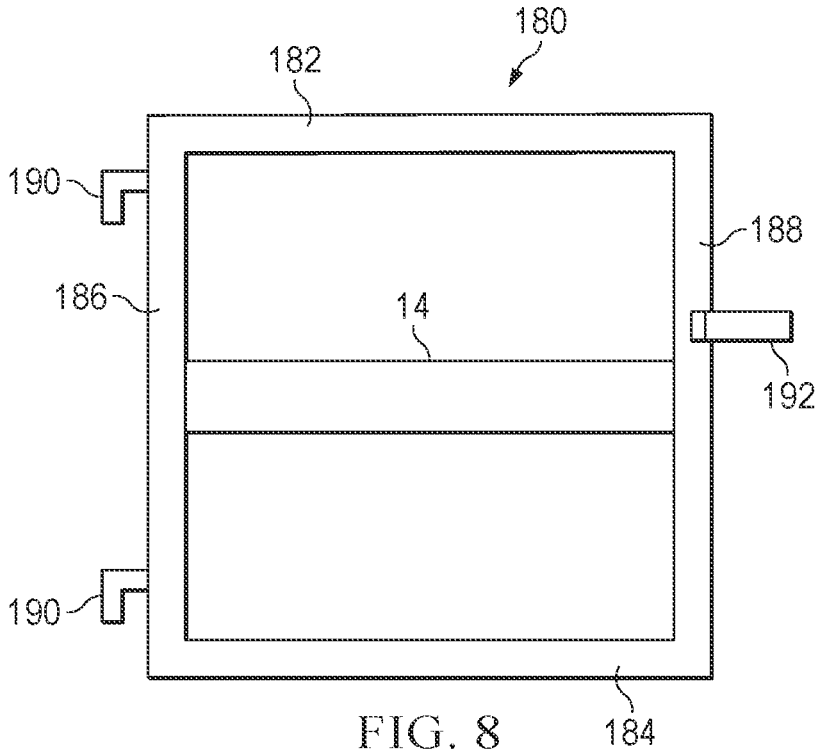
FIG. 8 is an elevation view of a gate for being rotationally supported by the gate hinge member of FIG. 7.

Gate 180 (FIG. 8) has a top member 182, a bottom member 184, a hinge side vertical member 186 and a latch side vertical member 188.

Hinge side vertical member 186 is provided with gate hinge members 190 for being rotationally received in hinge members 178 of gate post 170. Latch side vertical member 188 may be provided with latch 192. Infill member, e.g., horizontal slats 14 may be located between the hinge side vertical member 186 and the latch side vertical member 188.

Figure 9:
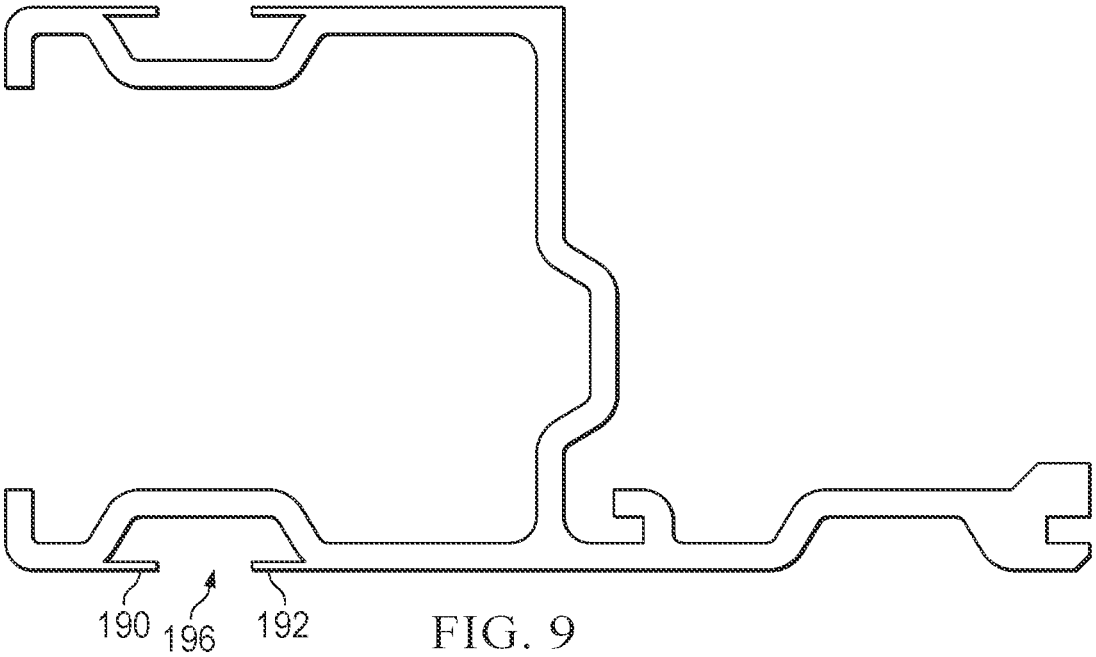
FIG. 9 is an enlarged plan view of an embodiment of the main post of FIG. 2, wherein the embodiment is provided with retaining members for receiving a retaining foot of an accessory.

In one embodiment, channels are provided with retaining members 190, 192 (see FIG. 9) for forming an accessory track 196.

Figure 10A:
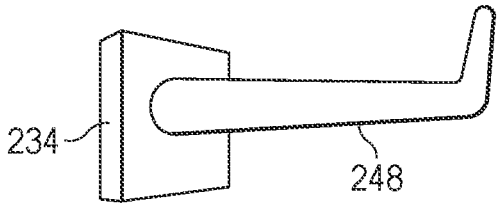
FIG. 10A is a perspective view of an example accessory in the form of a flower pot hanger or hook.
Figure 10B:
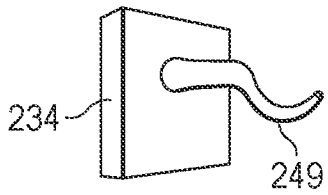
FIG. 10B is a perspective view of an example accessory in the form of a hand rail bracket.
Figure 10C:
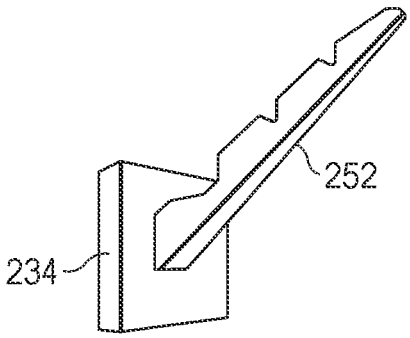
FIG. 10C is a perspective view of an example accessory barm arm or bar wire arm.
Figure 10D:
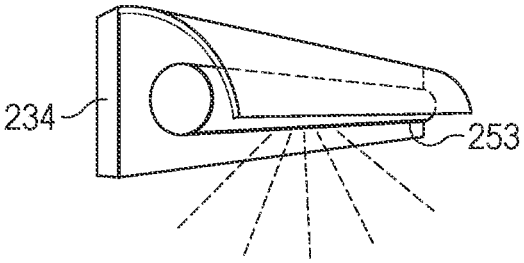
FIG. 10D is a perspective view of an example accessory in the form of a light.
Figure 10E:
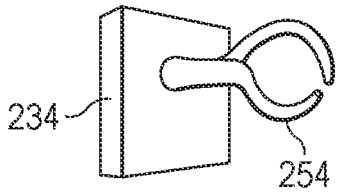
FIG. 10E is a perspective view of an example accessory in the form of a tubular bracket.
Figure 10F:
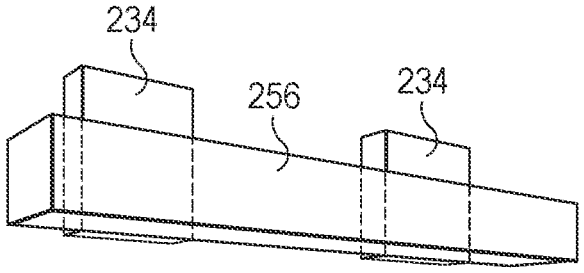
FIG. 10F is a perspective view of an example accessory in the form of a tubular bracket.
Figure 10G:
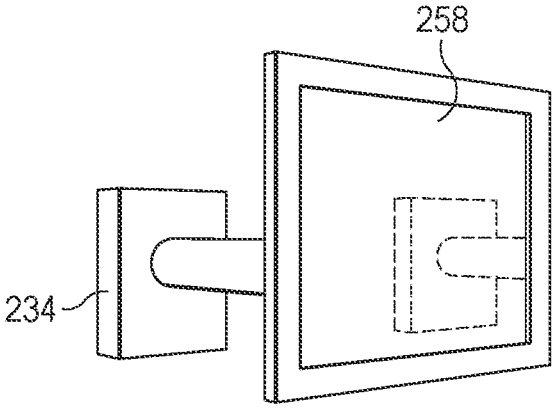
FIG. 10G is a perspective view of an example accessory in the form of a sign or frame.
Figure 10H:
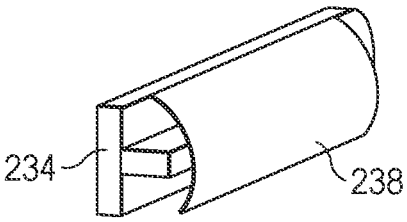
FIG. 10H is a perspective view of an example accessory in the form of a cover.

Preferably, a plurality of accessories 200 (FIGS. 10A-10H) are made available for a user to customize fence 12 by locating accessory foot 234 of an accessory in accessory track 196. Example accessories are shown in FIGS. 10A to 10G. Example accessories include a cover 238, (FIG. 10H), flower pot hanger or hook 248 (FIG. 10A), hand rail bracket 249 (FIG. 10B), barm arm or barb wire arm 252 (FIG. 10C) for security, light 253 (FIG. 10D), tubular bracket 254 (FIG. 10E), planter box 256 (FIG. 10F), and sign or frame 258 (FIG. 10G).

Accessory foot 234 may be held in place with a friction fit or by locating a fastener or clamp into or adjacent to accessory foot 234.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fence comprising:

a main post having a height, a front member, a rear member, a first end, a second end, a center member, and defining a longitudinal axis, said front member having an outside, an inside, and a terminal end, said rear member having an outside, an inside, and a terminal end, said center member having a first side and a second side, said center member connecting said front member and said rear member;

wherein a cross-section of said main post taken on a plane normal to the longitudinal axis of said main post has said front member and said rear member parallel to one another and normal to said center member;

a front connector at said terminal end of said front member;

a rear connector at said terminal end of said rear member;

wherein a secondary member is adapted to be longitudinally slidingly received by said front connector and said rear connector, wherein said secondary member defines a terminal end defining a complementary shape that nests within a shape defined by said front connector and said rear connector of said main post; and wherein one of said secondary member and said main post are adapted to slide vertically into one another.

2. The fence according to claim 1 wherein:

a first filler receptacle defined by said inside of said front member, said first side of said center member, and said inside of said rear member;

a second filler receptacle defined by said inside of said front member, said second side of said center member, and said inside of said rear member;

said center member is solid.

3. The fence according to claim 2 wherein:

infill is received in at least one of said first filler receptacle and said second filler receptacle.

4. The fence according to claim 3 wherein:

one of said outside of said front member and said outside of said rear member defines a channel;

said channel serves as a screw guide for securing said infill to said main post.

5. The fence according to claim 1 wherein:

one of said outside of said front member and said outside of said rear member defines a channel;

said channel is provided with retaining members for forming an accessory track for receiving an accessory.

6. The fence according to claim 1 wherein:

said secondary member is selected from a group consisting of a cap, a corner member, an angle member, and a gate member.

7. The fence according to claim 6 wherein:

said secondary member is said cap, said cap is received by said front connector of said main post and by said rear connector of said main post for covering a filler receptacle.

8. The fence according to claim 6 wherein:

said secondary member is said corner member, said corner member is received by said front connector of said main post and by said rear connector of said main post facilitating a right angle bend in the fence, said corner member defining a first corner post connector and a second corner post connector.

9. The fence according to claim 6 wherein:

said secondary member is said angle member, said angle member defines an attachment member that is received in said front connector and said rear connector for facilitating an angled bend in the fence of between 1 and 90 degrees, said attachment member of said angle member defining a first angle member connector and a second angle member connector;

said angle member further defining a filler receiving area wherein said filler receiving area is angularly offset from said attachment member.

10. The fence according to claim 1 wherein:

said front member is a sheet of material having a thickness;

said outside of said front member defines a front of said main post;

said inside of said front member defines a portion of a first filler receptacle.

11. A method of constructing a fence comprising the steps of:

installing a main post in a ground surface, said main post having a height, a front member, a rear member, a first end, a second end and a center member and defining a longitudinal axis, said front member having an outside, an inside and a terminal end, said rear member having an outside, an inside, and a terminal end, said center member having a first side and a second side, said center member for connecting said front member and said rear member;

wherein a cross-section of said main post taken on a plane normal to the longitudinal axis of said main post has said front member and said rear member parallel to one another and normal to said center member;

longitudinally slidably engaging a secondary member with a front connector at said terminal end of said front member and with a rear connector at said terminal end of said rear member, wherein said secondary member defines a terminal end having a complementary shape that nests within a shape defined by said front connector and said rear connector of said main post; and wherein one of said secondary member and said main post are slid vertically into one another.

12. The method according to claim 11 further comprising:

locating infill within a first filler receptacle defined by said main post on said first side of said center member; and locating infill within a second filler receptacle defined by said main post on said second side of said center member.

13. The method according to claim 12 further comprising:

passing a screw through said one of said front member and said rear member of said main post for securing said infill within one of said first filler receptacle and said second filler receptacle.

14. The method according to claim 13 wherein:

one of said front member and said rear member of said main post define a channel; and said step of passing the screw is through said channel wherein said channel serves as a screw guide for securing said infill to said main post.

15. The method according to claim 11 wherein:

one of said front member and said rear member define a channel; and said channel is provided with retaining members for receiving an accessory.

16. The method according to claim 11 wherein:

said secondary member is selected from a group consisting of a cap, a corner member, an angle member, and a gate member.

17. A fence comprising:

a main post having a front member, a rear member, and a center member between said front member and said rear member, said main post defining a longitudinal axis;

wherein a cross-section of said main post taken on a plane normal to the longitudinal axis of said main post has said front member and said rear member parallel to one another and normal to said center member;

a front connector adjacent said front member of said main post;

a rear connector adjacent said rear member of said main post;

said front connector and said rear connector configured for longitudinally slidably receiving a secondary member having a terminal end defining a complementary shape that nests within a shape defined by said front connector and said rear connector of said main post: and wherein one of said secondary member and said main post are adapted to slide vertically into one another.

18. A method of constructing a fence comprising the steps of:

installing a main post in a ground surface, said main post having a front member, a rear member, and a center member between said front member and said rear member, said main post defining a longitudinal axis;

wherein a cross-section of said main post taken on a plane normal to the longitudinal axis of said main post has said front member and said rear member parallel to one another and normal to said center member;

a front connector adjacent said front member of said main post;

longitudinally slidably engaging a secondary member with said front connector, said secondary member having a terminal end defining a complementary shape that nests within a shape defined by said front connector of said main post; and wherein one of said secondary member and said main post are adapted to slide vertically into one another.

* * * * *